US006899287B2

(12) United States Patent
Pinch et al.

(10) Patent No.: US 6,899,287 B2
(45) Date of Patent: May 31, 2005

(54) ROTARY SPRINKLER

(75) Inventors: Daniel R. Pinch, Clermont, FL (US); Gregory S. Burcham, Clermont, FL (US); Theodore G. Santiesteban, Ocoee, FL (US)

(73) Assignee: Senninger Irrigation Inc., Clermont, FL (US)

( * ) Notice: Subject to any disclaimer, the term of this patent is extended or adjusted under 35 U.S.C. 154(b) by 181 days.

(21) Appl. No.: 10/319,889

(22) Filed: Dec. 16, 2002

(65) Prior Publication Data

US 2004/0124266 A1 Jul. 1, 2004

(51) Int. Cl.[7] ..... B05B 1/34

(52) U.S. Cl. ..... 239/380; 239/252; 239/222.17; 239/214.13; 239/214.19; 239/222.11; 239/222.15

(58) Field of Search ..... 239/222.13, 205, 239/222.11, 222.17, 222.15, 204, 252

(56) References Cited

U.S. PATENT DOCUMENTS 4,660,766 A * 4/1987 Nelson et al. ..... 239/222.17
4,796,811 A * 1/1989 Davisson ..... 239/222.17
4,815,662 A * 3/1989 Hunter ..... 239/222.17
5,007,586 A * 4/1991 Cohen ..... 239/222.17
5,058,806 A * 10/1991 Rupar ..... 239/205
5,224,653 A * 7/1993 Nelson et al. ..... 239/222.17
5,718,381 A * 2/1998 Katzer et al. ..... 239/222.11
5,730,365 A * 3/1998 Messinger ..... 239/222.17
5,971,297 A * 10/1999 Sesser ..... 239/222.21
6,135,364 A * 10/2000 Nickish ..... 239/222.17
6,499,672 B1 * 12/2002 Sesser ..... 239/222.11
6,736,332 B2 * 5/2004 Sesser et al. ..... 239/204

* cited by examiner

*Primary Examiner*—David A. Scherbel
*Assistant Examiner*—James S. Hogan
(74) *Attorney, Agent, or Firm*—William M. Hobby, III

(57) ABSTRACT

An irrigation sprinkler with two viscous brakes. The viscous brakes work in conjunction with each other to maintain a low RPM and also to rotate a water stream diffuser. The water stream is first directed toward a deflector that offsets the stream and angles it toward the area to be watered. The offset stream applies a torsional force on the deflector causing it to rotate. The stream is then interrupted intermittently by the diffuser that is rotating at a different RPM. The end result is a sprinkler that rotates slowly and breaks up the stream of water intermittently to create an even pattern of water on the area being sprinkled without using mechanical parts, such as ratchets or gearing. This is desirable for smooth operation and less chance of the operation being interrupted from contamination by dirt, insects, debris, etc. Also, a more random diffusion of the water is obtained.

22 Claims, 4 Drawing Sheets

ROTARY SPRINKLER

BACKGROUND OF THE INVENTION

This invention relates to a rotary sprinkler and especially to a rotary sprinkler having a viscous brake retarding a rotatable water deflector and a rotatable water diffuser at different speeds of rotation.

A common form of rotary sprinkler includes a nozzle outputting a jet axially of the nozzle, and a rotor rotatably mounted with respect to the nozzle in alignment with the axial water jet and having a surface formation impinged by the water jet and effective to deflect the jet laterally of the nozzle and to rotate the rotor. Such rotary sprinklers, however, have a tendency to rotate at a high velocity, which decreases the effective range of the sprinkler. For this reason, such sprinklers have been provided with a retarding device or brake having a first surface rotatable with the rotor with respect to the nozzle, and a second surface with respect to the nozzle, and a viscous liquid between the two surfaces for retarding the rotation of the rotor. Sprinklers equipped with such retarding devices are described in U.S. Pat. Nos. 4,660,766 and 4,796,811. In the sprinklers described in the above patents, the surface rotatable with the rotor with respect to the nozzle is in the form of a pin secured to the rotor, and the surface non-rotatable with respect to the nozzle is in the form of a cavity formed in a part of the rotary sprinkler fixed to the nozzle and containing the viscous liquid. U.S. Pat. No. 5,007,586 has a rotary sprinkler, a nozzle outputting a water jet axially thereof; a rotor rotatably mounted with respect to the nozzle in alignment with the axial jet and having a surface formation impinged by the axial jet to deflect the jet laterally of the nozzle and to rotate the rotor; and a retarding device having a first surface rotatable with the rotor with respect to the nozzle, and a second surface non-rotatable with respect to the nozzle, and a viscous liquid between the first and second surfaces.

SUMMARY OF THE INVENTION

A rotary sprinkler has a sprinkler body having a center axis and a nozzle attached to the sprinkler body for outputting a stream of water therefrom along the center axis. The sprinkler has a rotor rotatably attached to the sprinkler body and a rotatable water deflector rotatably attached to the rotor with a viscous fluid coupling and positioned in the stream of water exiting the nozzle. The water deflector has a surface shaped to deflect the water impinging thereupon from the nozzle to rotate the water deflector and the rotor. A water diffuser is attached to the rotor for rotation therewith and positioned to intermittently intersect the stream of water deflected by the water deflector so that a rotary sprinkler deflects water with a rotary water deflector into a rotating and slower moving water diffuser. The sprinkler rotor has a viscous fluid brake formed on one end thereof for retarding the rotational speed of the rotor and of the diffuser and water deflector rotatably attached thereto. The water deflector is rotatably attached to the rotor with a viscous fluid coupling to thereby rotate the rotor with the deflector while allowing slippage between the rotor and the deflector.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
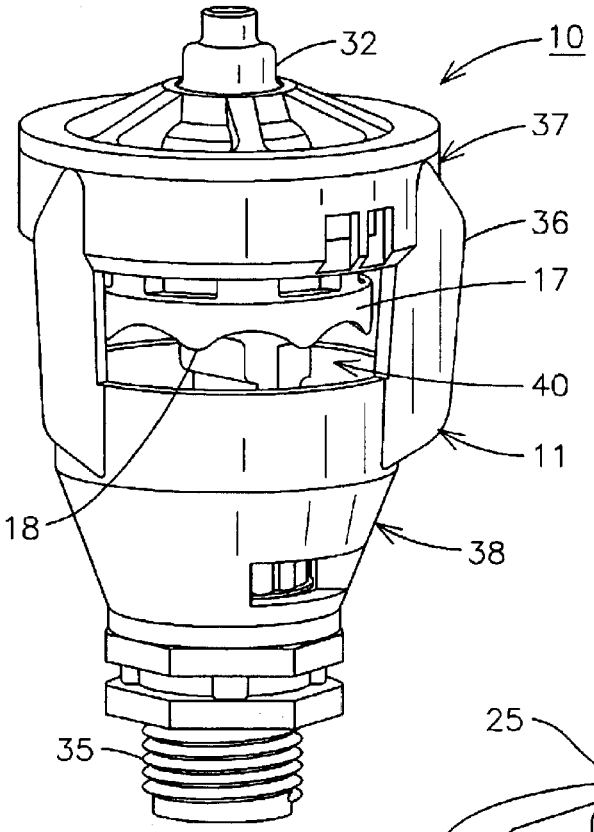
FIG. 1 is a perspective view of a rotary sprinkler in accordance with the present invention.

The purpose of this invention is to create an irrigation sprinkler with two viscous brakes, one of which also forms a fluid coupling and rotates a water stream diffuser at a different rate of speed from a rotatable water deflector. The viscous brakes work in conjunction with each other to maintain a low RPM of the water deflector and to rotate a water stream diffuser at an even slower rate. The advantage of using a viscous brake or retarder is to keep the unit rotating at approximately 1 to 4 RPM which low RPM keeps the provider radius of the stream as large as possible with greater coverage over the area being sprinkled.

Referring to the drawings FIGS. 1–7, a rotary sprinkler 10 has a sprinkler body 11 which has a nozzle 12 attached to the body for outputting a stream of water therefrom along a center axis of the sprinkler. Water is received at the input 13 of the nozzle 12 and outputted at the output end 14 where it is directed against a rotary deflector 15. The rotary deflector has one or more water deflecting grooves 16 for receiving the water from the output of the nozzle 12 and deflecting the water in a desired direction while at the same time acting to rotate the water deflector 15 from the water stream impinging thereupon against an angled surface in the deflector groove 16. The water deflector 15 directs the water towards a water stream diffuser 17 having raised surfaces 18 therein which rotates at a different speed from the water deflector 15 and thus intermittently intersects the water stream passing thereby with the water diffuser nodes 18.

A dual brake assembly 20 is mounted in the sprinkler and has a first viscous brake or retarder 21 and a second viscous brake 22, both of which are mounted to and form part of a central rotor 23. A first brake rotor portion 24 is attached to a central shaft 25 and is held in place by bearing 26 having an O-ring or other seal 27 around the shaft 25. The second viscous brake 22 has the rotary viscous brake portion 28 attached to the shaft 25 and is sealed with a bearing 30 and has an O-ring or other seal 31 around the shaft 25 to seal a viscous liquid between the brake rotor portion 28 and the surrounding portion of the sprinkler upper housing 32. Similarly, the bearing 26 seals in a viscous liquid around the brake portion 24 which holds the viscous liquid between the rotor portion 24 and the adjacent deflector portion 34 to form a braking or a viscous coupling between the rotary water deflector 15 and the rotor portion 24. The water deflector 15 rotates on the rotor portion 24 which rotation is retarded by the action of the viscous fluid. The deflection of the deflector 15 by the stream of water impinging thereupon rotates the deflector on the rotary brake portion 24 which in turn rotates the rotor 24 by the action of the fluid coupling. This in turn rotates the brake assembly 22 and rotates the rotor portion 28 against the viscous fluid to retard the rotation. Thus, the rotor 23 is turning at a slower speed than the deflector 15. As can be seen, one fluid brake 21 drives a second fluid brake 22 to retard the rotation of the water sprinkler.

Figure 2:
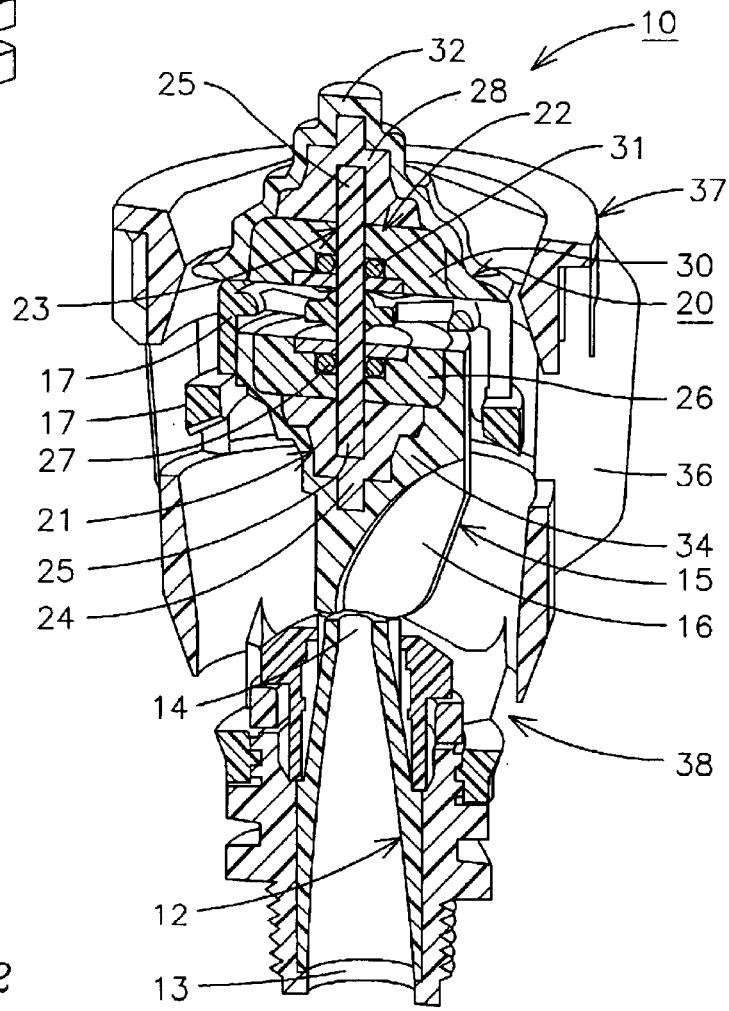
FIG. 2 is a cut away perspective view of the rotary sprinkler of FIG. 1.
Figure 3:
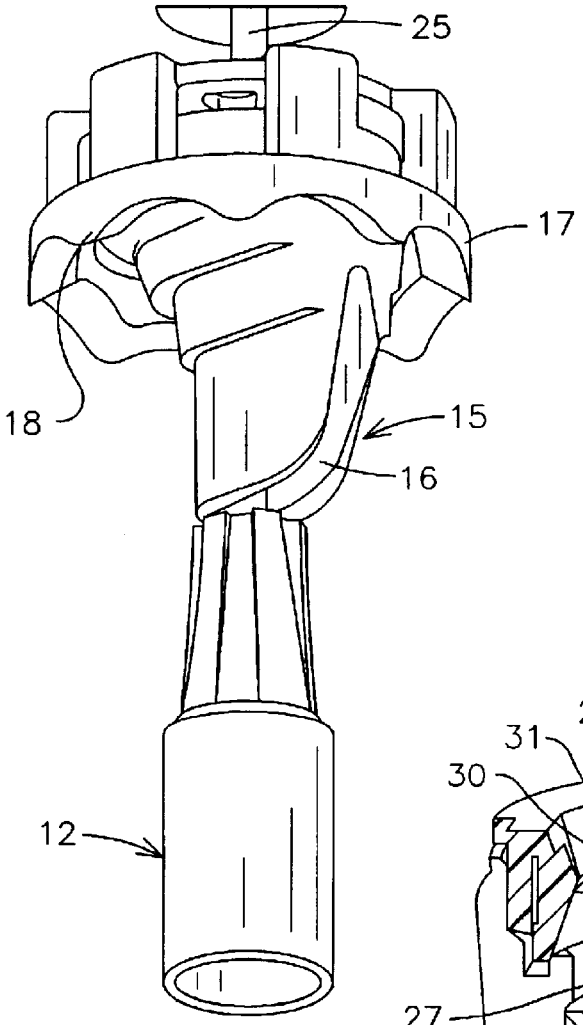
FIG. 3 is a perspective view of the nozzle and water deflector and water interrupter portion of the sprinkler of FIGS. 1 and 2.
Figure 4:
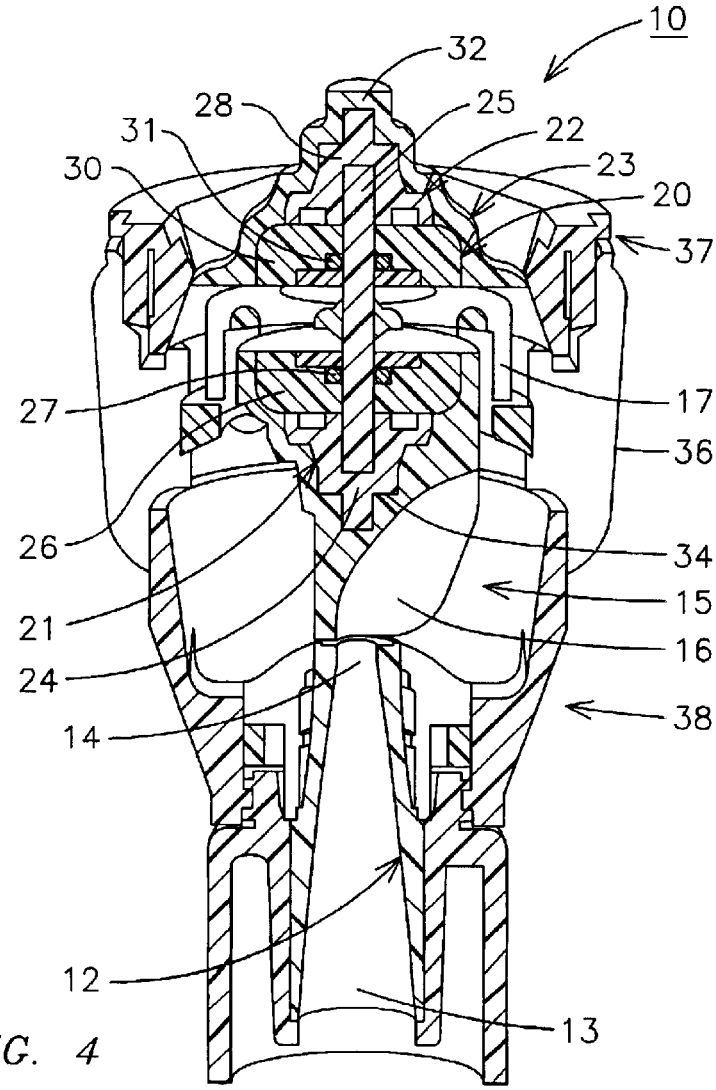
FIG. 4 is a cutaway perspective view of the sprinklers of FIGS. 1 and 2.
Figure 5:
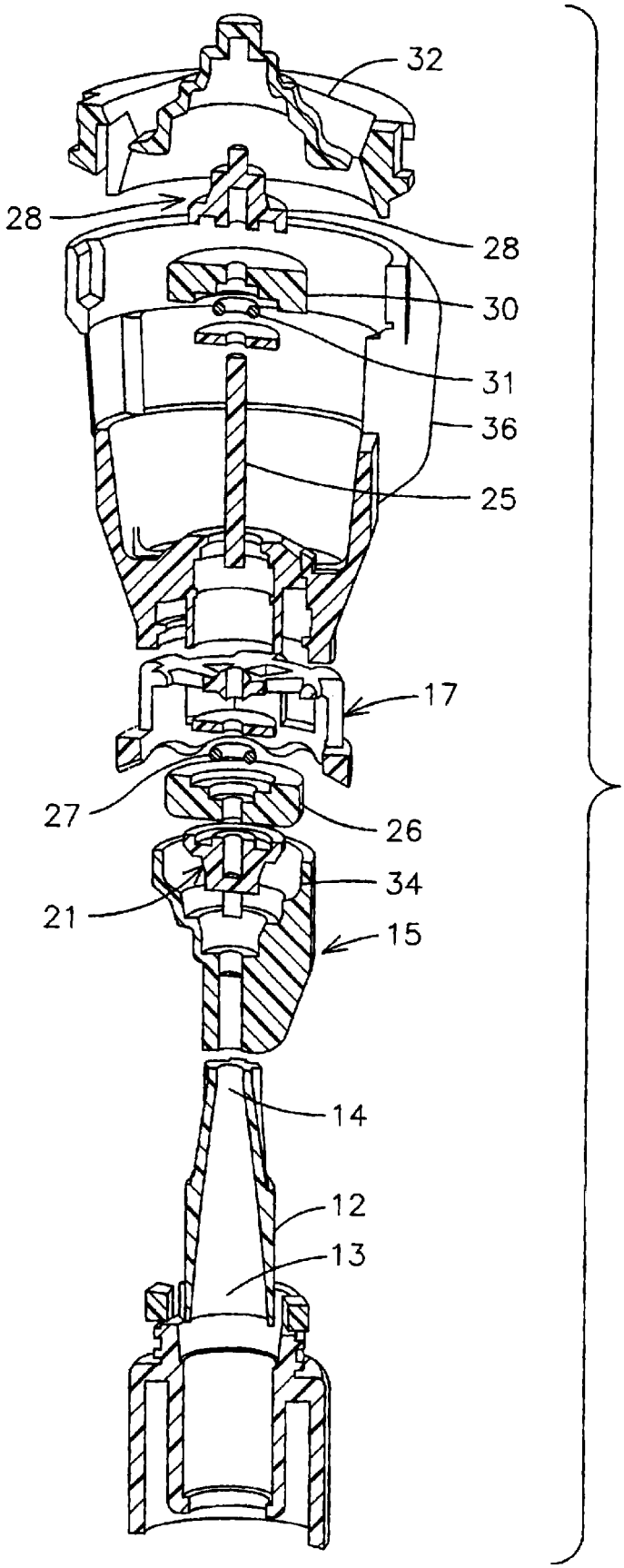
FIG. 5 is an exploded cutaway perspective view of the sprinkler of FIGS. 1 and 2.
Figure 6:
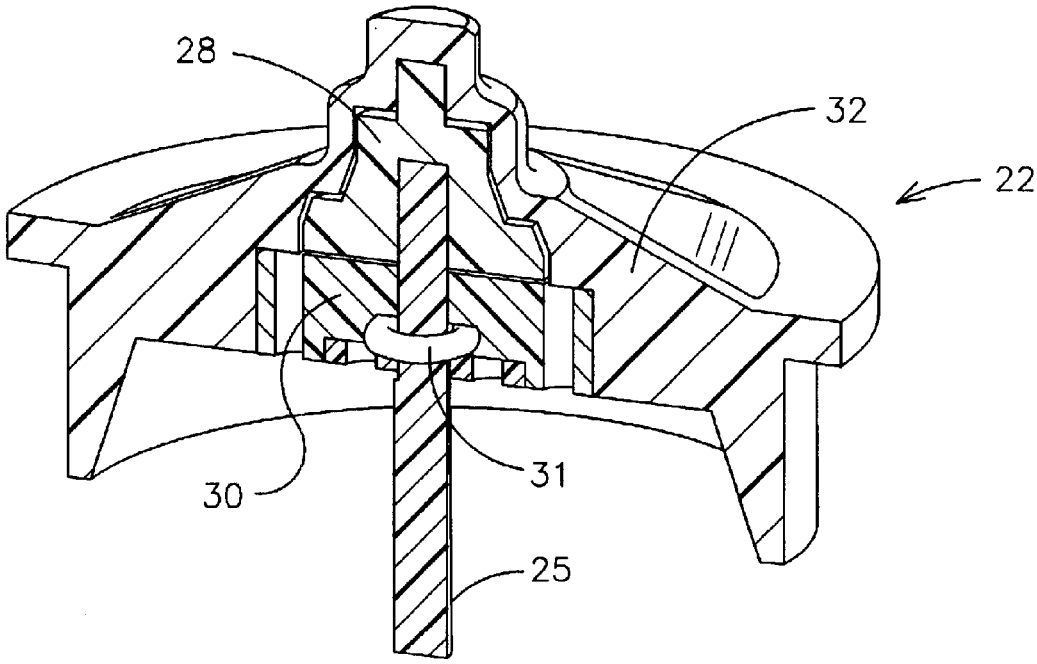
FIG. 6 is a cutaway perspective view of a viscous brake assembly.
Figure 7:
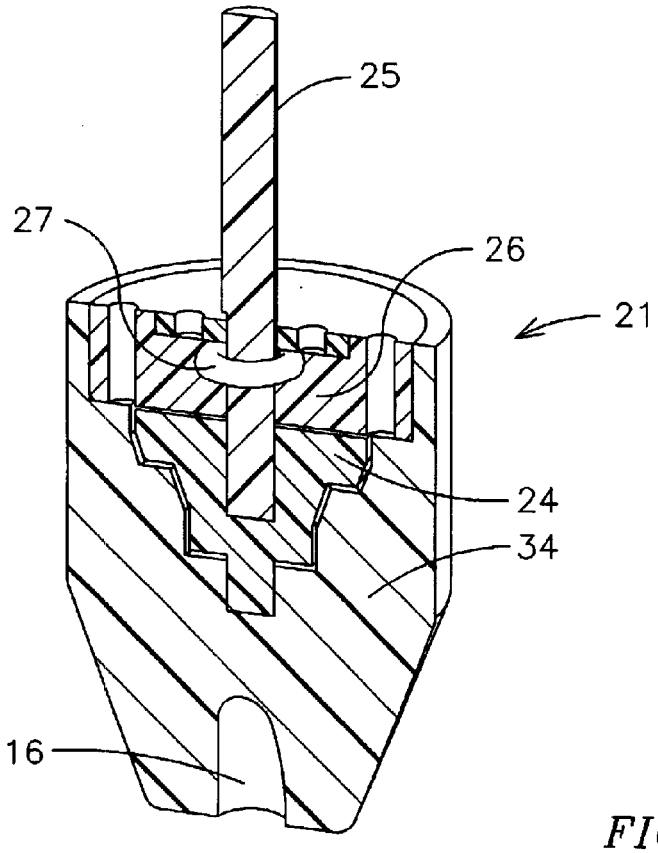
FIG. 7 is a cutaway perspective view of another viscous brake assembly.

The water diffuser 17 is attached to the rotor 23 shaft 25, as seen in FIGS. 2 and 4, and rotates with the rotor 23 at the same speed as the shaft 25 is turning. This is a lower speed than the water deflector 15 which is driving the rotor 23 and assures that the water diffuser will intermittently intersect the flow of water being deflected by the deflector 15 through the diffuser 17. The sprinkler body also has a threaded attachment 35 for attaching to an irrigation pipe or the like and arms 36 connecting the upper housing 37 to the lower sprinkler body 38 leaving the open area 40 for the escape of the deflected water from the sprinkler head 10.

In operation, the water stream is first directed from the nozzle 12 to the deflector 15. The deflector 15 offsets the stream and angles it toward the area to be watered, such as agricultural plants. The offset stream applies a torsional force on the deflector 15 causing it to rotate. After the stream leaves the deflector 15, it is then interrupted intermittently by the diffuser 17 that is turning at a slower RPM than the deflector 15. The end result is a sprinkler that rotates slowly and breaks up the stream of water intermittently to create an even pattern of water on the area being watered without using mechanical parts such as ratchets or gearing. This is desirable for smooth operation and less chance of the operation being interrupted from contamination by dirt, insects, debris, and the like. Also a more random diffusion of water is obtained.

The viscous fluid chambers are filled with a viscous fluid, such as dimethyl silicone 1,000,000 ct. If there was no fluid in the fluid chamber, the deflector would rotate at a high RPM. As the deflector rotates, the shearing action of the fluid between the deflector and the rotor causes the rotor to be dragged along forming a fluid coupling with a slipping motion. The brake assembly is kept from spinning freely by the action of the second brake. The rotor 23 having the shaft 25 and brake portions 24 and 28 is not fixedly attached to the deflector.

As the deflector 15 rotates, it causes the main rotor shaft 25 and the diffuser 17, fixedly attached thereto, to rotate but at a slower RPM. The purpose of the differential in RPMs is so that the stream of water leaving the deflector is interrupted intermittently by the diffuser.

The purpose of the second brake assembly 22 is to allow the deflector 15 and diffuser 17 combination to rotate. If the diffuser 17 did not rotate, the interruptions on the diffuser would remain in the same position relative to a fixed point and the stream of water would always be diffused at the same points, causing voids in the area being sprinkled. It can be seen that the two brakes work in conjunction with each other to constantly reposition the diffuser as the stream of water exiting the deflector rotates. This assures that there will not be areas that are devoid of water in the area being sprinkled. However, the present invention is not to be considered as limited to the forms shown which are to be considered illustrative rather than restrictive.

We claim:

1. A rotary sprinkler comprising:

a sprinkler body having a center axis;

a nozzle attached to said sprinkler body for outputting a stream of water therefrom along said center axis;

a rotor having two end portions and being rotatably attached to said sprinkler body;

a rotatable water deflector rotatably attached to said rotor with a viscous fluid coupling on one end thereof and being positioned in said steam of water exiting said nozzle, said water deflector having a surface shaped to deflect water impinging thereupon from said nozzle to rotate said water deflector;

a water diffuser attached to said rotor for rotation therewith and positioned to intermittently intersect said stream of water deflected by said water deflector; and a viscous fluid brake formed on the other end portion of said rotor with viscous fluid located between a part of said rotor and said sprinkler body for retarding the rotational speed of said rotor having said diffuser and water deflector rotatably attached thereto; whereby a rotary sprinkler deflects water with a rotary water deflector into a rotating water diffuser.

2. The water sprinkler in accordance with claim 1 in which said viscous coupling includes a viscous fluid positioned between a portion of said water deflector surface and a portion of said rotor surface to thereby rotate said rotor with said water deflector while allowing slippage between said water deflector and said rotor.

3. The water sprinkler in accordance with claim 2 in which said rotor viscous fluid coupling has an enlarged portion having a portion of said water deflector surface attached thereover and having said viscous fluid therebetween whereby said water deflector can rotate on said rotor.

4. The water sprinkler in accordance with claim 3 in which said viscous fluid brake has an enlarged rotor end portion surrounded by said sprinkler body and having said viscous fluid therebetween for said enlarged area to rotate therein.

5. The water sprinkler in accordance with claim 1 in which a first sealing cap is mounted to said sprinkler body around said rotor to seal said viscous fluid around said viscous fluid coupling enlarged portion to form said viscous fluid coupling with said water deflector.

6. The water sprinkler in accordance with claim 5 in which said first sealing cap has an o-ring seal sealing said rotor surface from leaking viscous fluid.

7. The water sprinkler in accordance with claim 6 in which a second sealing cap is mounted to said sprinkler body around said rotor to seal said viscous fluid around said viscous fluid brake enlarged portion to form a rotor viscous fluid brake.

8. The water sprinkler in accordance with claim 7 in which said second sealing cap has an o-ring seal sealing said rotor surface from leaking viscous fluid from said viscous fluid brake.

9. The water sprinkler in accordance with claim 8 in which said diffuser is attached to said rotor between said viscous fluid coupling and said viscous fluid brake.

10. The water sprinkler in accordance with claim 1 in which said rotor has a shaft portion having said viscous fluid brake on one end thereof and said viscous fluid coupling on the other end thereof and said diffuser is attached to said shaft portion between the ends thereof.

11. A rotary sprinkler comprising:

a sprinkler body having a center axis;

a nozzle attached to said sprinkler body for outputting a stream of water therefrom along said center axis;

a rotor rotatably attached to said sprinkler body;

a viscous fluid brake attached to said rotor for braking the rotation of said rotor;

a viscous fluid coupling attached to said rotor; and a rotatable water deflector rotatably attached to said rotor with said viscous fluid coupling and being positioned in said steam of water exiting said nozzle, said water deflector having a surface shaped to deflect water impinging thereupon from said nozzle and to rotate said water deflector and rotor against said viscous fluid brake;

whereby a rotary sprinkler rotary water deflector is braked by a viscous fluid brake and viscous fluid coupling.

12. A rotary sprinkler in accordance with claim 11 including a water diffuser attached to said rotor for rotation therewith and positioned to intermittently intersect a stream of water deflected by said water deflector.

13. The water sprinkler in accordance with claim 12 including a viscous fluid positioned between a portion of said water deflector surface and a portion of said rotor surface to thereby rotate said rotor with said water deflector while allowing slippage between said water deflector and said rotor.

14. The water sprinkler in accordance with claim 12 in which said rotor has a first enlarged end portion having a portion of said water deflector surface attached thereover and having said viscous fluid therebetween whereby said water deflector can rotate on said rotor.

15. The water sprinkler in accordance with claim 11 in which said viscous fluid brake rotor has an second enlarged end portion surrounded by said sprinkler body and having a viscous fluid therebetween for said second enlarged area to rotate therein.

16. The water sprinkler in accordance with claim 11 in which a first sealing cap is mounted to said sprinkler body around said rotor to seal said viscous fluid around said first enlarged portion to form said viscous fluid coupling with said water deflector.

17. The water sprinkler in accordance with claim 16 in which a first sealing cap has an o-ring seal sealing said rotor surface from leaking viscous fluid.

18. The water sprinkler in accordance with claim 11 in which a second sealing cap is mounted to said sprinkler body around said rotor to seal said viscous fluid around said second enlarged portion to form a rotor viscous fluid brake.

19. The water sprinkler in accordance with claim 18 in which a second sealing cap has an o-ring seal sealing said rotor surface from leaking viscous fluid from said viscous fluid brake.

20. The water sprinkler in accordance with claim 19 in which said diffuser is attached to said rotor between said viscous fluid coupling and said viscous fluid brake.

21. The water sprinkler in accordance with claim 13 in which said rotor has a shaft portion having said viscous fluid brake on one end thereof and said viscous fluid coupling on the other end thereof and said diffuser is attached to said shaft portion between the ends thereof.

22. A dual viscous brake rotary sprinkler comprising:

a sprinkler body;

a dual brake rotor rotatably attached to said sprinkler body and having dual viscous brakes thereon, one said viscous brake being coupled to said sprinkler body to brake the rotation of said rotor;

a rotatable water deflector rotatably coupled to a second of said rotor viscous brakes for braking the rotation of said water deflector coupled thereto; and a nozzle attached to said sprinkler body for outputting a stream of water therefrom onto said water deflector to rotate said water deflector on said second viscous brake; whereby a pair of coupled viscous brakes brake both the rotation of the water deflector supporting rotor and the water deflector mounted thereto.

* * * * *